United States Patent [19]

Jones et al.

[11] Patent Number: 4,698,925

[45] Date of Patent: Oct. 13, 1987

[54] SOIL RECLAIMING IMPLEMENT

[76] Inventors: Harry A. Jones, Industrial Park Rd. (P.O. Box 104), Steeleville, Ill. 62288; Avery Wheetley, R.R. 1, Box 4, Makanda, Ill. 62958

[21] Appl. No.: 821,484

[22] Filed: Jan. 22, 1986

[51] Int. Cl.[4] ..... E02F 3/40; E02F 3/32

[52] U.S. Cl. ..... 37/2 R; 172/40; 172/766; 172/763

[58] Field of Search ..... 172/40, 766, 697, 691, 172/694, 777, 763; 37/DIG. 18, 2 R

[56] References Cited

U.S. PATENT DOCUMENTS

| | | | |
|---|---|---|---|
| 2,303,415 | 12/1942 | Williams | 37/2 R |
| 2,491,208 | 12/1949 | Price | 37/2 R |
| 2,985,973 | 5/1961 | Struemph | 37/2 R |
| 3,274,710 | 9/1966 | Wright | 37/2 R |
| 3,448,813 | 6/1969 | Rogers | 172/40 |
| 4,224,995 | 9/1980 | Alberger | 172/697 |
| 4,517,755 | 5/1985 | Nicholson | 37/2 R |

FOREIGN PATENT DOCUMENTS

| | | | |
|---|---|---|---|
| 987698 | 3/1965 | Australia | 37/2 R |
| 697646 | 11/1979 | U.S.S.R. | 172/40 |

*Primary Examiner*—Richard J. Johnson
*Attorney, Agent, or Firm*—Kalish & Gilster

[57] ABSTRACT

Apparatus for processing of soil by vibratory sifting to remove rocks and other objects embedded in the soil provides a scoop for use with a backhoe or crawler tractor having a positionable boom. The scoop includes an elongated main frame to which are secured arcuately configured evenly spaced tines which extend downwardly from the main frame with sharp distal ends for readily penetrating the soil. By pivot arrangement, the main frame is secured to an outer end of the boom for placement upon the surface, the tines extending into the soil for processing. A hydraulic vibrator motor is coupled to the tines for causing vibratory sifting by the tines of the soil upon the main frame being pulled across the surface. Such operation sifts rocks and other objects from the soil. The apparatus is especially useful for processing the root medium after strip mining.

16 Claims, 12 Drawing Figures

SOIL RECLAIMING IMPLEMENT

BACKGROUND OF THE INVENTION

The present invention relates to soil processing, and more particularly, to a processor for reclaiming the so-called "root medium" over acreage which has been surface mined.

During such surface mining, sometimes called strip mining, wherein overburden is displaced by sometimes immense machinery for recovering coal or other minerals below the surface, massive amounts of earth are displaced resulting in a layer of spoil many feet deep which, because of the stripping operation, has incorporated into it large rocks, roots, logs and other coarse debris. Following such surface mining, it is desired to reclaim the mined acreage to provide a top layer of several feet in depth consisting of texture (including soil, dirt, mixed medium including rock or other objects not larger than a certain size) which is then to be covered by a layer of topsoil. Thus, there may be four feet of texture covered by an additional one foot depth of topsoil, and together constituting the "root medium". In reclaiming the root medium, it has heretofore been required to use large earth moving equipment, including rubber-tired equipment as well as crawler tractors. Such equipment is used for removing rock and other undesired objects larger than a predetermined dimension, such as 10 in.$^2$, such large objects may not be permitted in the texture portion of the root medium, and no rock may be permitted within the top soil layer, which may be termed the "plow zone".

It has been found that such earth moving equipment is very cumbersome for reclaiming operations, and presents difficulties including ineffective removal of rock and other large objects. There is a tendency for scraper blades and the like to become jammed and damaged by objects, particularly large rock for example. In using rake-type equipment, a common problem is that rocks or debris are "stirred" and frequently are lost from in front of the rake, being incorporated back into the root medium.

Another problem is the compaction of the root medium because of the weight and continued travel over the root medium by such earth moving equipment. Concerning compaction, it may be assumed that undisturbed acreage suitable for farming will have a compaction of not greater than about 68%. When the root medium of reclaimed acreage is compacted by earth moving equipment, approaching a maximum compaction of 100%, roots of row crops will not penetrate the root medium, and such compaction must be alleviated if the reclaimed land will be utilizable for prime agricultural purposes. To overcome the compaction problem, it has been attempted to utilize conventional rippers, as well as rock or root rakes. Such apparatus may be towed or pushed to drag deeply submerged cutting or lifting elements through the soil being reclaimed. The use of such equipment is itself detrimental, as it is itself causative of compaction, but primarily is objectionable because it necessitates an expensive and equipment-intensive operation which it would be desirable to avoid.

In general, there has not existed any aparatus, machine or combination thereof for satisfactorily eliminating foreign materials and objects from acreage to be reclaimed as well as for avoiding undesirable compaction. Further, existing conditioning equipment has relied upon lifting and overturning large amounts of soil, requiring powerful equipment with accompanying high cost and full consumption.

SUMMARY OF THE INVENTION

It is an object of the present invention to provide a root medium processor for reclaiming the root medium following surface mining, such as strip mining, by very effectively removing undesired objects and materials from the root medium as well as avoiding compaction thereof.

It is a further object of the present invention to provide such a processor which loosens and frees the root medium to provide it with a relatively low compaction percentage such as will enable the reclaimed acreage to be utilized for agricultural purposes, including the cultivation of row crops, and which when processing avoids retravel over the area being processed such as would cause recompaction, the processor allowing a pattern of processing to be developed so that the processor need travel only once over any given area, permitting successive, sequential passes in such a manner that neither the processor nor other equipment needs to be driven back over the processed root medium.

Further, it is an object of the present invention to provide such a processor which utilizes a vibrating, sifting motion combined with movement such as will enable it to lift in a very reliable and effective manner various rocks, roots and other objects deeply imbedded within the root medium, and in a manner which avoids mixing such rocks or other objects back into the root medium, while permitting such objects and materials to be safely deposited in a trailer or other hauler for being transported out of the area being processed; but without lifting of overburden and root medium such as heretofore been required.

Also an object of the invention is the provision of such a processor which allows processing to be initiated at any given point within an area, and to be terminated at a desired point without disruption or loss of processing effectiveness, such that processing need not continue in an uninterrupted manner but instead may be initiated and terminated at will.

Among still other objects of the invention may be noted the provision of such a processor which can be constructed by the use of existing tractor-backhoe equipment, or which can be utilized by mounting upon other types of equipment such as crawler tractors and the like; which is extremely rugged and free from damage while in use but, if damaged, is field-repairable; which in operation is powered by hydraulic fluid under pressure, as is readily supplied by existing equipment.

It may also be observed that an object of the invention is the provision of such a processor which carries out processing in a very efficient, energyconserving manner by avoiding the direct, costly and energy-consumptive lifting of overburden and root medium such as heretofore been required; and which in general provides such simple, low-cost, cleaning of the root medium that the cost for processing per cubic yard of root medium is at least an order of magnitude cheaper than existing technology.

Briefly, the invention encompasses apparatus for soil processing by vibratory sifting to remove rocks and other objects embedded in the soil. The apparatus is used with a mobile implement such as a track-equipped vehicle, e.g., a backhoe, or a crawler tractor, which is moveable along the surface of acreage to be processed, such implement having a positionable boom or the like. The processor comprises a sifting scoop including a main frame of elongated character. Multiple, evenly spaced blades, i.e., tines have ends interconnected with the main frame and extend downwardly from the main frame, the tines having sharp distal ends for readily penetrating the soil. By a pivot arrangement, including means for adjusting of the angular orientation of the main frame relative to ground, the main frame is secured to an outer end of the boom for being positioned at the surface, and with the implement causing transverse movement of the main frame across the surface with the tines extending into the soil for processing. Vibrator means interconnected with the teeth cause them to vibrate, producing vibratory sifting of the soil upon such transverse movement of the main frame, causing sifting of rocks and other objects from the soil. The boom is liftable for causing the sifted rocks and other objects to be lifted by the teeth and thereby removed.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
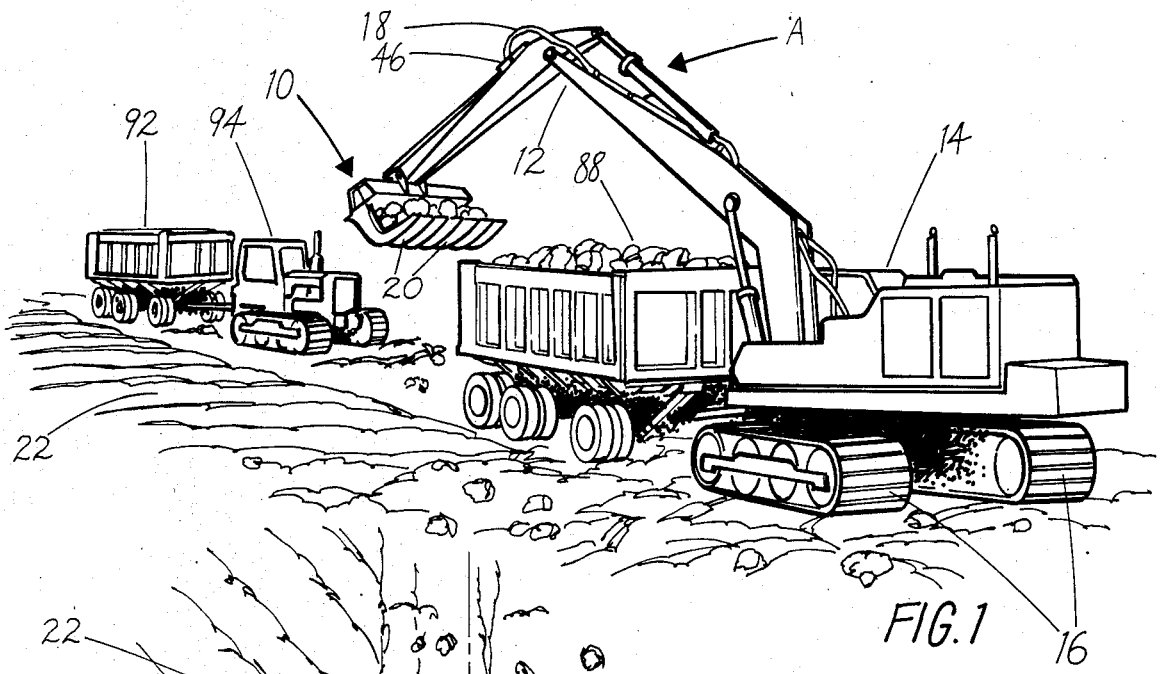
FIG. 1 is a perspective view of a processor constructed in accordance with and embodying the present invention as shown in use.
Figure 2:
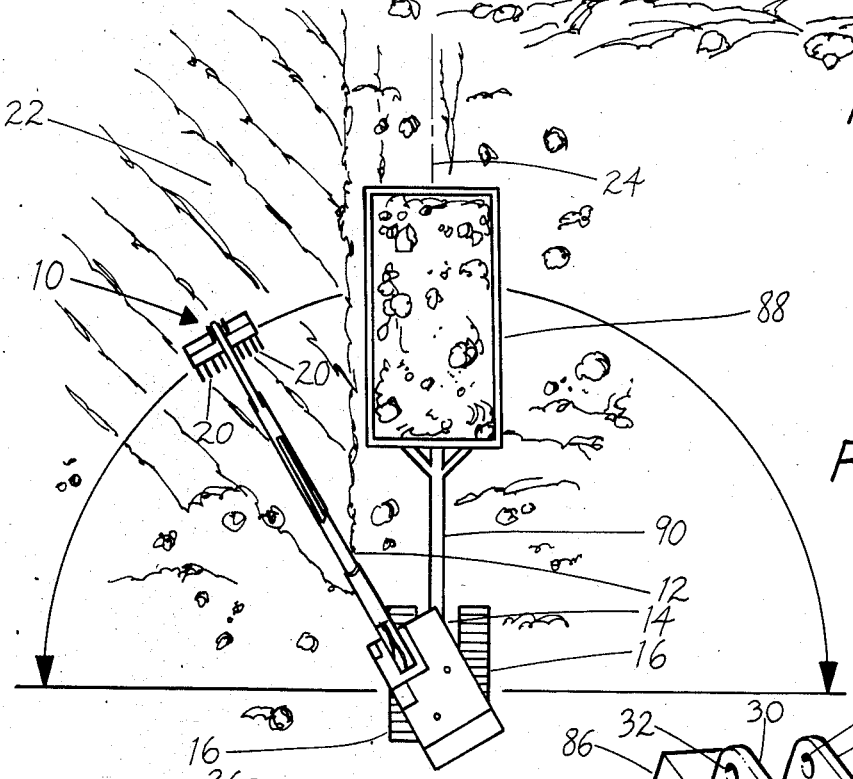
FIG. 2 is a top plan view of the processor, including an area being processed by the processor, as illustrative of a pattern of its operation.

Referring to FIGS. 1 and 2, a first embodiment A of the invention is provided by a soil sifting scoop generally designated 10 as mounted at the outer, distal end of a boom 12 of a mobile implement such as a track-equipped vehicle, and most specifically a backhoe of large, heavy duty type having tracks 16, 16' for movement along the surface of acreage to be processed, such as the so-called "root medium" over acreage which has been surface mined.

Scoop 10, in response to hydraulic fluid pressure provided by the backhoe by hydraulic lines 18 extending along the boom, provides vibratory sifting of the soil to remove rocks and other objects embedded in the soil. For this purpose, scoop 10 is provided with closely spaced multiple blades 20 constituting tines which are caused to penetrate the earth and to provide a raking, sifting action by manipulation of boom 12, providing a processed region 22 along the path of movement 24 of backhoe 16, as it is moved incrementally in the direction shown by an arrow 26 (FIG. 2).

Figure 3:
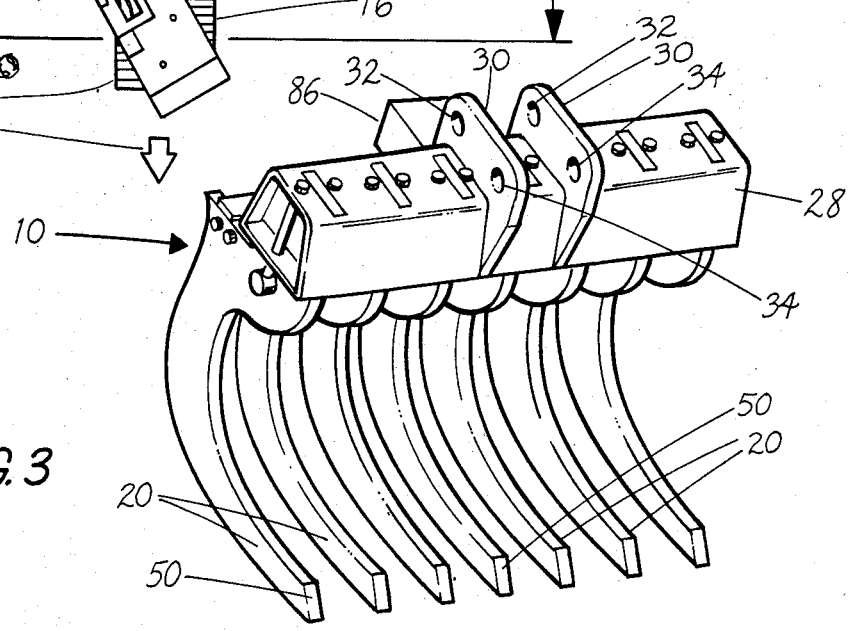
FIG. 3 is a perspective view of a processing assembly of the invention and constituting active portions of the processor.

Referring now to FIG. 3, scoop 10 includes a main frame 28 of elongated configuration, being intended for mounting in a direction transverse to boom 12. For mounting purposes, main frame 28 is provided with large mounting brackets 30, 30' having apertures as at 32, 32' and 34, 34' for receiving corresponding pins 36, 38 (FIG. 6) carried at the outer end of the boom.

Figure 6:
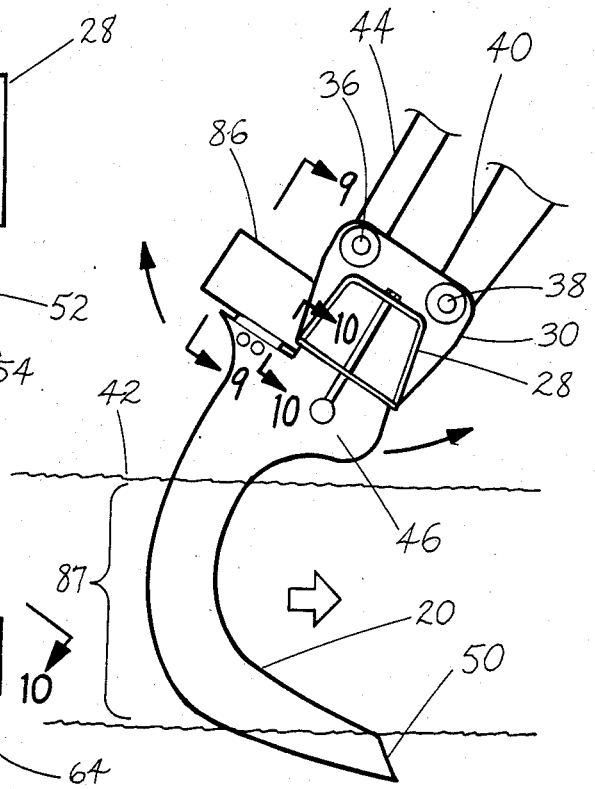
FIG. 6 is a side elevation view of the apparatus of FIG. 3.

As shown in FIG. 6, the outer end of the boom is designated at 40, with main frame 28 being thereby mounted for pivoting of the main frame relative to ground level 42. At 44 is shown the outer portion of a connecting rod or the like which extends from a hydraulic cylinder 46 (FIG. 1). Operating rod 44 is extended or retracted in response to hydraulic pressure controlled by the operator to rotate main frame 20 about the axis of pin 38 to a desired orientation relative to ground level 42.

Figure 7:
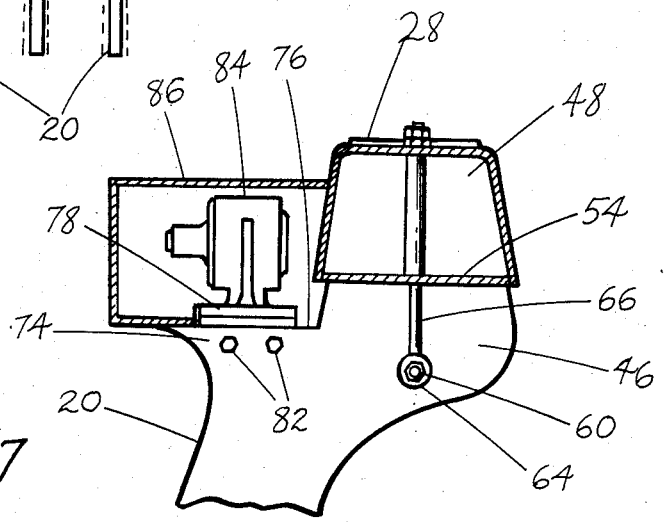
FIG. 7 is a vertical cross section as taken along line 7—7 of FIG. 5.

Blades 20 are generally of arcuate character, and have proximal ends removably secured to the main frame 28. As shown in FIGS. 6 and 7, the proximal, or mounting end 46 of each blade is provided with an upward extension 48 of trapezoidal configuration for being received within the main frame 28 which is of corresponding trapezoidal cross section, said upward extension 48 constituting a securement portion having forward and rearward edges of continuously diverging configuration.

Figure 4:
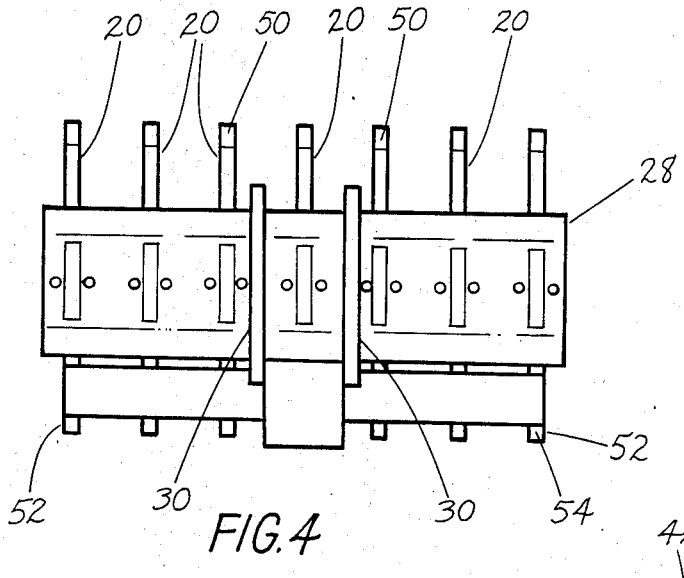
FIG. 4 is a top plan view of the apparatus of FIG. 3.

The blades 20 are each formed of steel and are spaced evenly, and in parallel orientation, along the length of main frame 28, as best seen in FIG. 4. The spacing is selected to provide for capture and removal of rocks and other objects of diameter greater than the spacing, such as a few inches.

The outer, or distal end of each blade or tine 20 is defined by a bevelled edge 50 for providing a sharp tip which will readily penetrate the soil. The tip may be heat treated or case hardened for increased hardness.

Figure 10:
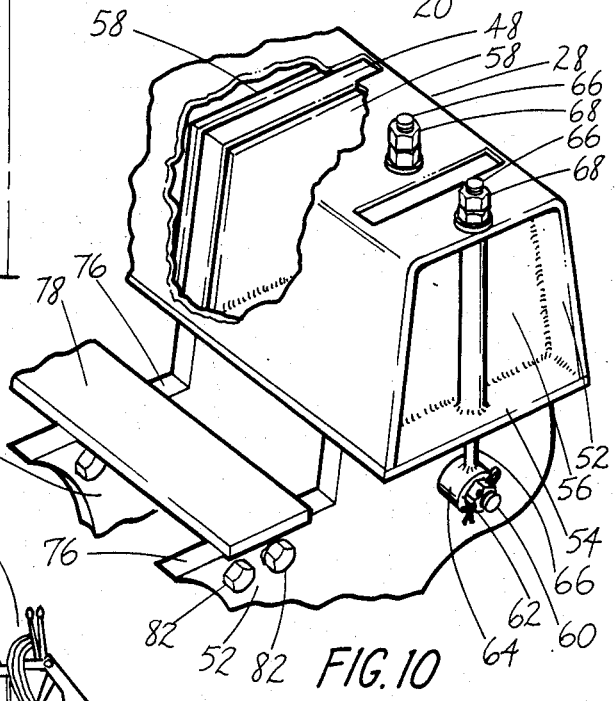
FIG. 10 is a perspective view of fragmentary character, partially sectioned, for illustration of certain structure of the apparatus of FIG. 3.

Main frame 28 is defined by a channel member 52 (FIGS. 7 and 10) of inverted generally U-shaped character which is closed by a plate 54 welded to it, and with end blades, as at 56, at opposite ends of the resultant box-like configuration of the main frame. Each of the upper blade portions 48 is received within a corresponding recess provided within the main frame by blades, as at 58, 58' welded in it and the recesses opening downwardly to receive the blade respective extension 48. Each such recess 58 is, like each blade securement portion 48, of continuously downwardly diverging configuration. FIG. 10 best illustrates this feature. Each blade is maintained within its so-defined recess by a support arrangement which includes a large bolt 60 which extends through an aperture 62 in the blade which in turn extends through sleeves 64, 64' which are carried at the lower end of respective support rods 66, 66' which extend up through the box-like main frame and are affixed by bolts, as at 68, 68'. Each main support bolt 60 is maintained captive by a nut 70 and lock pin 72.

This arrangement permits each of blades 20 to be easily and quickly removed, separately from other blades, in the event of damage during use, or for replacement purposes. Only a few minutes time is required for changing a blade but, in use, the recess arrangement for each blade securely receives the substantial entirety of the securement portion 48 of each blade and permits thousands of pounds of force to be transferred between the blade and frame, as may be imposed by loads occuring during use.

Figure 9:
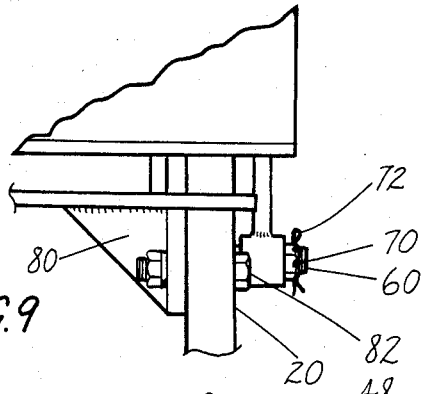
FIG. 9 is a fragmentary elevation, as taken along 9—9.

The upper portions of each of the blades 20 is extended rearwardly to define for each blade a shoulder portion 74 including a flat upper surface 76. Extending across the surfaces 76 so-defined is a plate 78 (see also FIG. 10) which is secured to each of the blades by a respective bracket 80 (FIG. 9), the same being secured to each of the blades by a pair of bolts 82, 82'. Centrally affixed to plate 56 is a hydraulic vibrator motor 84 of suitable commercially available rotational type, such as heretofore utilized for causing vibration of rail cars or the like for shaking of coal or other granular materials from rail car hoppers.

Figure 5:
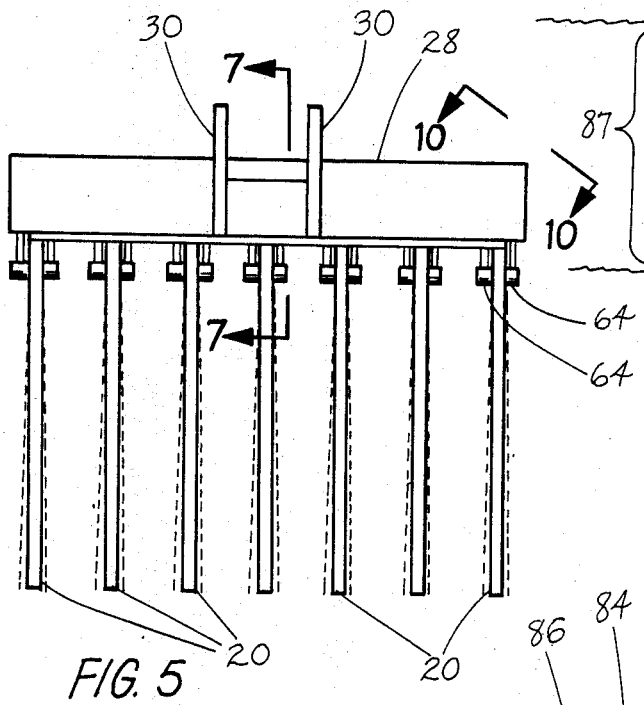
FIG. 5 is a front elevation view of the apparatus of FIG. 3.

Vibrator motor 84, during operation, is provided with hydraulic fluid by lines 18 (see FIG. 1; not shown in FIG. 7) for causing plate 78 to vibrate with lateral shifting, and coupling such vibration by means of said brackets 80 to each of blades 20. This produces a lateral vibration of each of the blades depicted by dashed lines in FIG. 5, and with such vibration reaching substantial amplitude because of the resilience of the blade steel and imparting a sifting action such that soil will be caused to be sifted through the blades when the apparatus is pulled through the soil by movement of main frame 28 across the soil surface, as depicted in FIG. 6.

Vibrator motor 84 may be of the type for providing vibration at cyclic rates of from a few hundred to several thousand cycles per minute, and a cyclic rate of 150 cycles per minute has been found suitable. To protect the vibrator motor from damage resulting from rocks and soil during use, a welded steel plate enclosure 86 is provided (FIGS. 3, 6 and 7). The enclosure extends rearwardly from main frame 28 to enclose and protectively surround the vibrator motor. The enclosure is located rearwardly of the main frame so that the enclosure will be on the trailing edge of the scoop as the scoop 10 is moved, through the soil with teeth 20 submerged within the soil for processing, and in that way the enclosure is itself protected by the main frame.

Operation of the new processor for reclaiming of soil such as particularly the root medium of acreage which has been surface mined entails submerging blades 20 within the root medium, which is designated 87. Then, by manipulation of boom 12 or other prime mover to which scoop 10 is connected, the blades are pulled through the soil in the direction indicated by arrow in FIG. 6 to cause vibratory sifting of the soil and entrapping rocks and other large objects in front of the blades because of their C-shaped, arcuate configuration. Periodically, scoop 10 may be lifted from the soil and such rocks or other objects dumped into a suitable transport vehicle, such as a trailer 88 coupled by a tongue 90 to the backhoe 14 or loaded into a truck or other vehicle such as the trailer 92 pulled by a crawler tractor 94 (FIG. 1).

Figure 11:
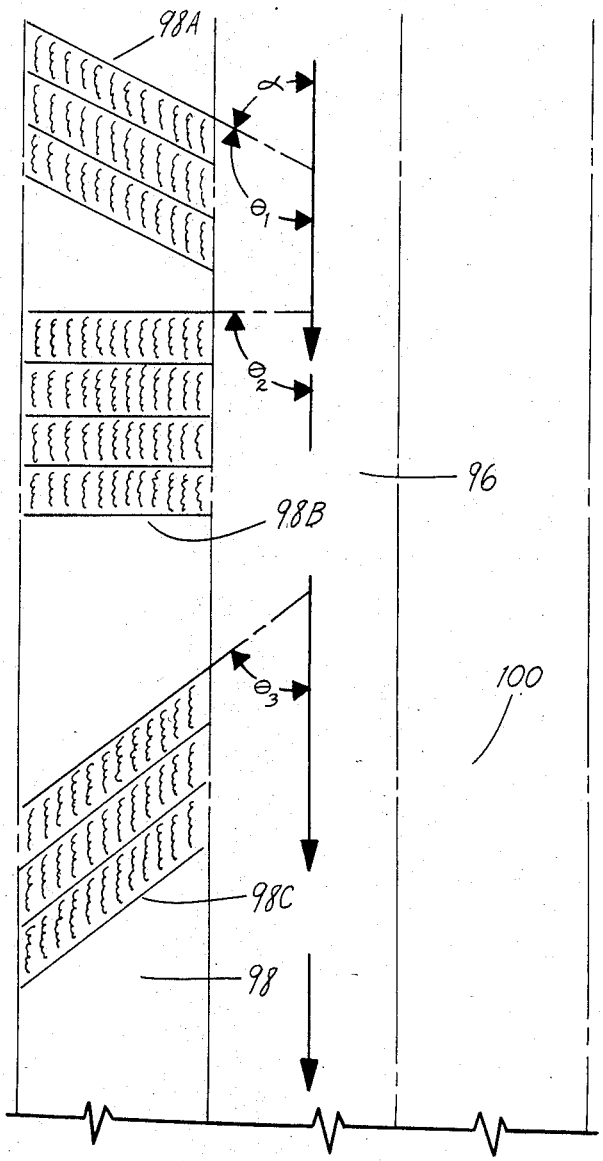
FIG. 11 is a top plan view of an area of acreage being processed depicting a pattern of processing utilizing the new processor.
Figure 8:
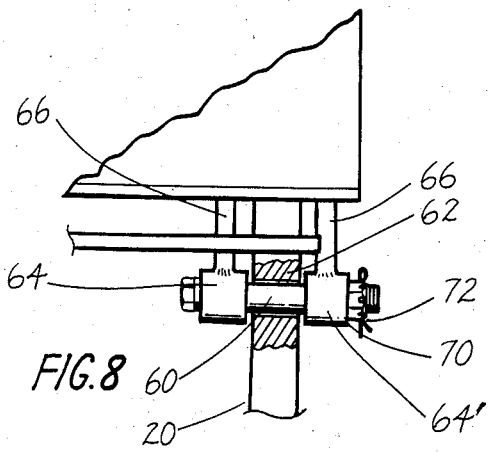
FIG. 8 is a fragmentary elevation, partially sectioned, to illustrate the securement of certain teeth of the processor.

In processing according to a system including a backhoe 14 or other prime mover, the new processing apparatus preferably involves movement in such a way as to produce a pattern of processing shown in FIG. 11. There, the path of movement along a strip of land 96 is shown by arrows, it being understood that the backhoe 14 and any such trailer 88 will move centrally along strip 96 for processing of an adjacent strip 98. Processing may be effected in various ways, such as orienting the boom at an obtuse angle $\theta_1$ to provide a processed region 98A of successive passes of the scoop as the backhoe is incrementally moved along its direction of travel. A second such region 98B is shown wherein the boom is oriented to form an angle $\theta_2$ which is preferably substantially 90°. A third processed region 98C is shown wherein the boom is oriented at an angle $\theta_3$ which is acute relative to the direction of travel. When a trailer 88 is pulled, the use of an obtuse angle $\theta_1$ allows the boom when lifting the scoop free from soil being processed to be oriented only over an acute angle $\alpha$ for dumping of rocks and other debris into the trailer and return once more to its processing orientation.

However, although $\theta$ may thereby range from 0° to 180°, the right angle relationship shown for processing of region 98B is most preferred since it allows the width of the strip 98 to be maximized by permitting the longest possible reach of the boom while the backhoe is moving along strip 96. After processing of strip 98 throughout its entire length, the backhoe may be moved to the center of the next strip 100 for processing of the full length of strip 96. Accordingly, the new system permits processing in a manner which avoids compaction of the root medium since it does not require the equipment to travel over a processed strip or area.

Figure 12:
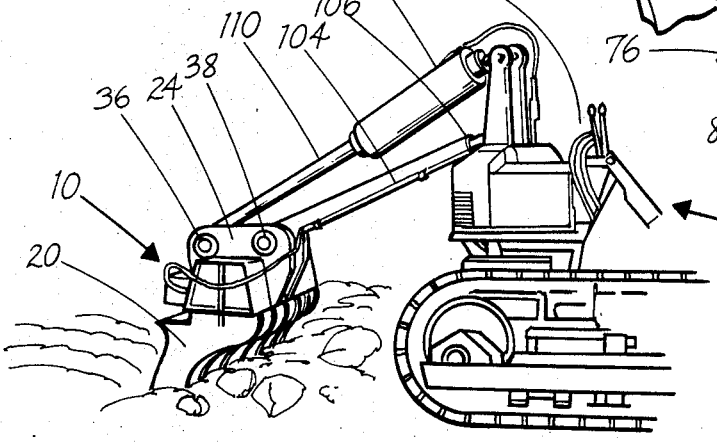
FIG. 12 is a perspective view of an alternative utilization of the new processor, i.e., as mounted at the rear of a crawler tractor.

Referring to FIG. 12, a second embodiment of the invention is designated B. A system according to this embodiment involves a crawler tractor 102 having a boom 104 pivotally mounted at the rear of the tractor at a point 106, such boom being connected by a pin 38 to main frame 24, and with there being a hydraulic cylinder 108 having an actuating rod 110 connected to pin 36 so that scoop 10 maybe oriented at a desired angle relative to ground and with the system causing the teeth 20 to penetrate the soil for processing by vibratory sifting as tractor 102 is moved along a region to be processed. Periodically, as necessary, scoop 10 may be lifted from the soil for removal of rocks and other large objects which are captured in front of the blades as it is pulled through the soil.

In view of the foregoing, it will be seen that the several objects of the invention and other advantages are achieved by the new constructions which have been described.

Although the foregoing includes the description of the best mode of the embodiments contemplated for carrying out the invention, various modifications are contemplated.

As various modifications could be made in the constructions herein described and illustrated without departing from the scope of the invention, it is intended that all matter contained in the foregoing description or shown in the accompanying drawing shall be interpreted as illustrative rather than limiting.

What is claimed is:

1. Apparatus for processing of soil by vibratory sifting to remove rocks and other objects embedded in the soil, the apparatus being for use with a mobile implement, the implement being movable along the soil surface of acreage to be processed, the apparatus comprising an elongated main frame, a plurality of arcuately configured evenly spaced tines of blade-like character having proximal ends interconnected with the main frame, the tines extending downwardly from the main frame and having distal ends for penetrating the soil, and means for placement of the main frame upon the soil surface with the tines extending into the soil for processing upon transverse movement of the main frame across the soil surface by the impelement, the main frame defining recesses opening downwardly for receiving respective tines, the recesses being shaped to correspond to the cross-section of the tines, the proximal ends of the tines each including a trapezoidal securement portion of continuously downwardly diverging configuration for being received in substantial entirety within a respective recess, means for securing the proximal ends of the tines within the respective recesses in independently removable relationship, each recess being also of continuously downwardly diverging configuration for providing reduced dimensions at uppermost extents of both the securement portion and the recess for thereby facilitating removal of the tines for replacement or repair, and vibrator means for causing vibration of the tines to cause vibratory sifting of the soil upon such transverse movement of the main frame whereby to sift rocks and other objects from the soil with the tines.

2. Apparatus as set forth in claim 1 wherein the mobile implement includes a boom, and means for securement of the main frame to the outer end of the boom.

3. Apparatus as set forth in claim 2, wherein the main frame is pivotally connected by the securement means to the boom, and further comprising means for controllably positioning the angular orientation of the main frame relative to ground level defined by the soil surface.

4. Apparatus as set forth in claim 3 wherein the positioning means comprises a hydraulic cylinder interconnecting the mobile implement and the main frame.

5. Apparatus as set forth in claim 4 wherein the hydraulic cylinder is interconnected also with the boom.

6. Apparatus as set forth in claim 4 wherein the mobile implement is a backhoe.

7. Apparatus as set forth in claim 4 wherein the mobile implement is a crawler tractor.

8. Apparatus as set forth in claim 6 wherein the backhoe is operable along a direction of travel defining a strip of acreage for travel of the backhoe and the boom is oriented at an angle of from 0° to 180° the direction of travel for processing of a further strip of acreage adjacent to the first-said strip.

9. Apparatus as set forth in claim 8 wherein $\theta$ is a right angle.

10. A processing system including the apparatus of claim 1 wherein the mobile implement is a backhoe including a boom, means for pivotally securing the main frame to the outer end of the boom with controllable angular orientation relative to ground level defined by the soil surface.

11. A processing system according to claim 10 wherein the boom is liftable for causing the sifted rocks and other objects to be lifted by the tines for removal, the processing system including a vehicle for receiving rocks and other objects lifted by the tines.

12. Apparatus for processing of soil by vibratory sifting to remove rocks and other objects embedded in the soil, the apparatus being for use with a mobile implement having a positionable boom or the like, the implement being movable along the surface of acreage to be processed, the apparatus comprising an elongated main frame, a plurality of arcuately configured evenly spaced tines having proximal ends interconnected with the main frame, the tines extending downwardly from the main frame and having sharp distal ends for readily penetrating the soil, means for securement of the main frame to an outer end of the boom for placement of the tines upon the soil surface for transverse movement of the main frame across the surface by the implement with the tines extending into the soil for processing and for adjusting the angular orientation of the main frame with respect to the ground, the tines being of blade-like character having rectangular cross-section, the main frame defining recesses of corresponding cross-section opening downwardly for receiving respective tines, and means for securing the proximal ends of the tines within respective recesses in independently removable relationship, the tines including securement portions of tapered configuration for providing reduced dimensions at uppermost extents of both the tine securement portions and the recesses, thereby to facilitate removal of the tines for replacement or repair, and vibrator means interconnected with the tines for causing vibration of the tines to cause vibratory sifting of the soil upon transverse movement of the main frame across the surface whereby to sift rocks and other objects from the soil with the tines, the boom being liftable for causing the sifted rocks and other objects to be lifted by the tines and thereby removed.

13. Apparatus as set forth in claim 12, the tines being of parallel relationship and having a spacing between adjacent tines for defining the size of rocks and other objects to be sifted for removal.

14. Apparatus as set forth in claim 13 wherein the tines are of C-shaped configuration.

15. Apparatus for processing of soil by vibratory sifting to remove rocks and other objects embedded in the soil, the apparatus being for use with a mobile implement having a positionable boom or the like, the implement being movable along the surface of acreage to be processed, the apparatus comprising an elongated main frame, a plurality of arcuately configured evenly spaced tines constituted by blades having proximal ends interconnected with the main frame, the blades extending downwardly from the main frame and having sharp distal ends for readily penetrating the soil, means for securement of the main frame to an outer end of the boom for placement upon the soil surface for transverse movement of the main frame across the surface by the implement with the blades extending into the soil for processing, and vibrator means interconnected with the blades for causing vibration of the tines to cause vibratory sifting of the soil upon such transverse movement of the main frame whereby to sift rocks and other objects from the soil with the blades, the boom being liftable for causing the sifted rocks and other objects to be lifted by the blades and thereby removed, the vibrator means comrpising at least one vibrator motor and means interconnecting the motor with upper portions of the blades for imparting vibration to the blades, the vibrator motor being of hydraulic rotational type, the interconnecting means comprising a longitudinal member secured to an upper portion of each of the blades, the vibrator motor being affixed to the longitudinal member, the vibrator motor being powered by the mobile implement and producing vibration of from several hundred to several thousand cycles perminute, each blade including an upper securement portion, the main frame defining recesses opening downwardly for receiving the blade securement portion rearwardly of the securement portion, each blade further including a shoulder portion rearwardly of the securement portion, the longitudinal member being secured to each blade shoulder portion with the longitudinal member located rearwardly of the main frame.

16. Apparatus for processing of soil by vibratory sifting to remove rocks and other objects embedded in the soil, the apparatus being for use with a mobile implement having a positionable boom or the like, the implement being movable along the surface of acreage to be processed, the apparatus comprising an elongated main frame, a plurality of arcuately configured evenly spaced tines constituted by blades having proximal ends interconnected with the main frame, the blades extending downwardly from the main frame and having sharp distal ends for readily penetrating the soil, means for securement of the main frame to an outer end of the boom for placement upon the soil surface for transverse movement of the main frame across the surface by the implement with the blades extending into the soil for processing, and vibrator means interconnected with the blades for causing vibration of the tines to cause vibratory sifting of the soil upon such transverse movement of the main frame whereby to sift rocks and other objects from the soil with the blades, the boom being liftable for causing the sifted rocks and other objects to be lifted by the blades and thereby removed, the vibrator means comprising at least one vibrator motor and means interconnecting the motor with upper portions of the blades for imparting vibration to the blades, the vibrator motor being of hydraulic rotational type, the interconnecting means comprising a longitudinal member secured to an upper portion of each of the blades, the vibrator motor being affixed to the longitudinal member, the vibrator motor being powered by the mobile implement and producing vibration of from several hundred to several thousand cycles per minute, each blade including an upper securement portion, the main frame defining recesses opening downwardly for receiving the blade securement portion rearwardly of the securement portion, the longitudinal member being secured to each blade at said upper portion of the respective blade at a location spaced from the respective blade securement portion, the longitudinal member being located rearwardly of the blade securement portions.

* * * * *